US007786658B1

(12) United States Patent
Tanaka et al.

(10) Patent No.: US 7,786,658 B1
(45) Date of Patent: Aug. 31, 2010

(54) ELECTRON-EMITTING DEVICE AND IMAGE DISPLAY APPARATUS USING THE SAME

(75) Inventors: Junya Tanaka, Tokyo (JP); Shin Kitamura, Tokyo (JP); Tamaki Kobayashi, Tokyo (JP); Tsuyoshi Takegami, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 29 days.

(21) Appl. No.: 12/421,773

(22) Filed: Apr. 10, 2009

(30) Foreign Application Priority Data

Feb. 6, 2009 (JP) ..... 2009-026488

(51) Int. Cl.
*H01J 1/02* (2006.01)

(52) U.S. Cl. ..... 313/309; 313/495

(58) Field of Classification Search ..... 313/309, 313/336, 351, 495
See application file for complete search history.

(56) References Cited

U.S. PATENT DOCUMENTS

| | | | | |
|---|---|---|---|---|
| 6,225,749 | B1 | 5/2001 | Kobayashi et al. | 315/169.3 |
| 6,288,485 | B1 | 9/2001 | Takegami et al. | 313/495 |
| 6,346,773 | B1 | 2/2002 | Takegami | 315/169.1 |
| 6,624,589 | B2 | 9/2003 | Kitamura et al. | 315/169.3 |
| 6,633,118 | B1 | 10/2003 | Yamamoto et al. | 313/495 |
| 6,642,649 | B1 | 11/2003 | Yamamoto et al. | 313/495 |
| 6,731,060 | B1 | 5/2004 | Yamamoto et al. | 313/495 |
| 6,802,753 | B1 | 10/2004 | Ando et al. | 445/6 |
| 6,843,696 | B2 | 1/2005 | Kitamura et al. | 445/24 |
| 6,848,962 | B2 | 2/2005 | Kitamura et al. | 445/24 |
| 6,849,999 | B1 | 2/2005 | Kobayashi et al. | 313/495 |
| 6,851,995 | B2 | 2/2005 | Takegami et al. | 446/6 |
| 6,929,522 | B1 | 8/2005 | Takegami | 445/6 |
| 6,933,664 | B2 | 8/2005 | Kitamura et al. | 313/309 |
| 6,960,111 | B2 | 11/2005 | Takegami et al. | 445/24 |
| 7,131,886 | B2 | 11/2006 | Kitamura et al. | 445/51 |
| 7,198,966 | B2 | 4/2007 | Kitamura et al. | 438/20 |
| 7,230,372 | B2 | 6/2007 | Yamamoto et al. | 313/311 |
| 7,249,990 | B2 | 7/2007 | Shimazu et al. | 445/50 |
| 7,264,530 | B2 | 9/2007 | Kobayashi et al. | 445/35 |
| 7,271,529 | B2 | 9/2007 | Takeda et al. | 313/311 |
| 7,312,561 | B2 | 12/2007 | Moriguchi et al. | 313/310 |
| 7,513,814 | B2 | 4/2009 | Kobayashi et al. | 445/24 |
| 7,528,538 | B2 | 5/2009 | Kitamura et al. | 313/495 |
| 7,582,001 | B2 | 9/2009 | Kitamura et al. | 445/50 |

(Continued)

FOREIGN PATENT DOCUMENTS

| | | |
|---|---|---|
| JP | 9-330646 | 12/1997 |

(Continued)

*Primary Examiner*—Vip Patel
(74) *Attorney, Agent, or Firm*—Fitzpatrick, Cella, Harper & Scinto

(57) ABSTRACT

An electron-emitting device has an insulating layer having a side surface, a recess portion formed on the side surface of the insulating layer, a gate electrode which is arranged above the recess portion, and a wedge-shaped emitter which is arranged on an edge of a lower side of the recess portion and has a first slope on a side of the recess portion and a second slope on a side opposite to the recess portion. A lower end of the first slope of the emitter enters the recess portion, and both the first slope and the second slope of the emitter tilt to an outside of the recess portion.

5 Claims, 10 Drawing Sheets

U.S. PATENT DOCUMENTS

| | | | | |
|---|---|---|---|---|
| 7,582,002 | B2 | 9/2009 | Yamamoto et al. | 445/51 |
| 7,583,015 | B2 | 9/2009 | Nukanobu et al. | 313/309 |
| 2007/0135012 | A1 | 6/2007 | Takegami | 445/24 |
| 2007/0188067 | A1 | 8/2007 | Tsukamoto et al. | 313/309 |
| 2007/0209192 | A1 | 9/2007 | Shimazu et al. | 29/592.1 |
| 2008/0001521 | A1 | 1/2008 | Kitamura | 313/496 |
| 2009/0180946 | A1 | 7/2009 | Kitamura et al. | 423/447.3 |
| 2009/0244398 | A1 | 10/2009 | Nukanobu et al. | 348/725 |

FOREIGN PATENT DOCUMENTS

| | | |
|---|---|---|
| JP | 2001-167693 | 6/2001 |

ELECTRON-EMITTING DEVICE AND IMAGE DISPLAY APPARATUS USING THE SAME

BACKGROUND OF THE INVENTION

1. Field of the Invention

The present invention relates to an electron-emitting device and an image display apparatus using the electron-emitting device.

2. Description of the Related Art

Field emission electron-emitting devices are devices which field-emit electrons from the cathode electrode by a voltage applied between a cathode electrode and a gate electrode. Japanese Patent Application Laid-Open (JP-A) No. 2001-167693 discloses an electron-emitting device which is provided a cathode along a side surface of an insulating layer provided onto a substrate and has a recess portion on a part of the insulating layer.

SUMMARY OF THE INVENTION

In electron-emitting devices, electron emission efficiency is requested to be further heightened. The electron emission efficiency ($\eta$) is derived according to the efficiency $\eta$=Ie/(If+Ie) by using an electric current (If) flowing between the cathode electrode and the gate electrode at the time of applying a drive voltage to the electron-emitting device and an electric current (Ie) taken out into a vacuum.

The present invention is devised in order to solve the above problem, and its object is to provide an electron-emitting device which has high electron emission efficiency in a simple constitution and is driven stably, and an image display apparatus using the devices.

A first aspect of the present invention is an electron-emitting device including:

an insulating layer having a side surface;

a recess portion which is formed on the side surface of the insulating layer;

a gate electrode which is arranged above the recess portion; and a wedge-shaped emitter which is arranged on an edge of a lower side of the recess portion and has a first slope on a side of the recess portion and a second slope on a side opposite to the recess portion (opposite to the first slope), wherein a lower end of the first slope of the emitter enters the recess portion, both the first slope and the second slope of the emitter tilt to an outside of the recess portion.

A second aspect of the present invention is an image display apparatus including:

a plurality of electron-emitting devices and a light-emitting member which emits light due to electrons emitted from the plurality of electron-emitting devices, wherein each of the electron-emitting devices is the electron emitting device according to the first aspect of the present invention.

The present invention provides the electron-emitting device which has high electron emission efficiency in a simple constitution and is driven stably, and the image display apparatus using the devices.

Further features of the present invention will become apparent from the following description of exemplary embodiments with reference to the attached drawings.

DESCRIPTION OF THE EMBODIMENTS

An embodiment is exemplary described in detail below with reference to the drawings. The scope of the present invention is not limited only to dimensions, materials, shapes and relative arrangements of components described in the embodiment unless otherwise noted.

(Constitution of the Electron-Emitting Device)

An electron-emitting device according to the embodiment which enables stable electron emission is described first.

Figure 1A:
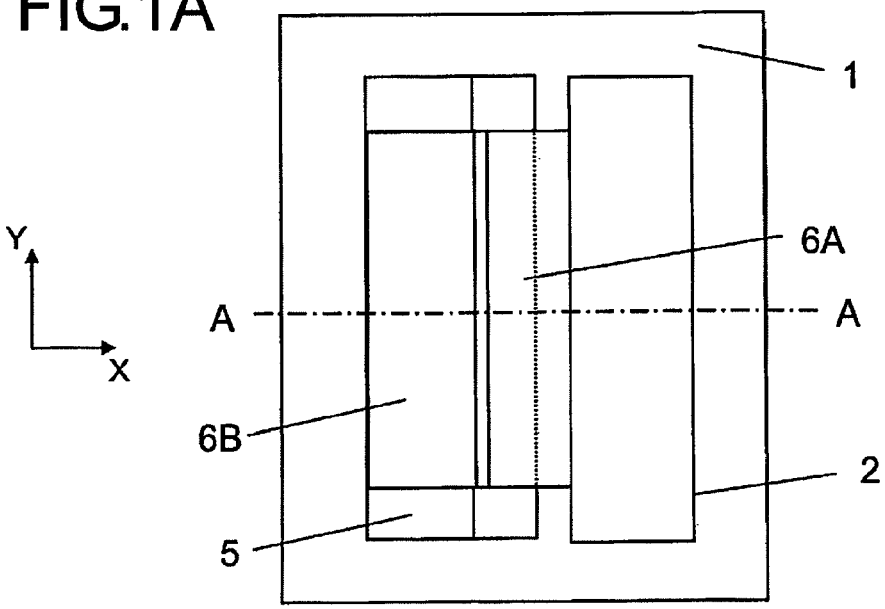
FIGS. 1A to 1C are diagrams illustrating one example of a constitution of an electron-emitting device.
Figure 1B:
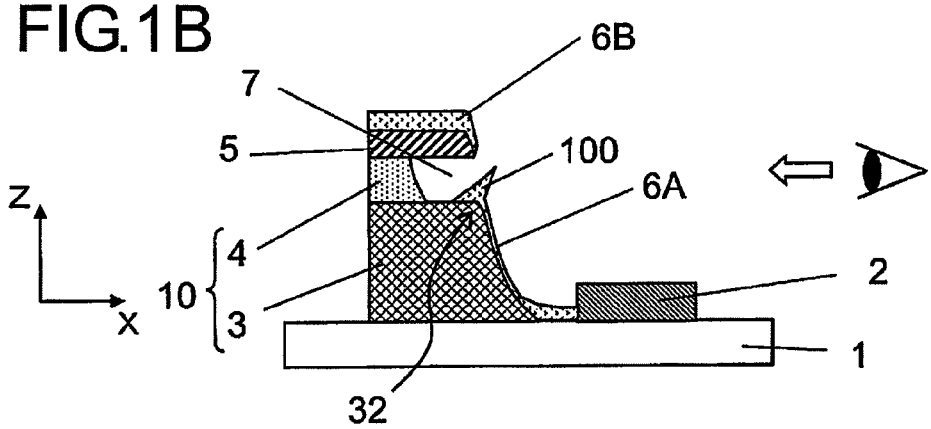
Figure 1C:
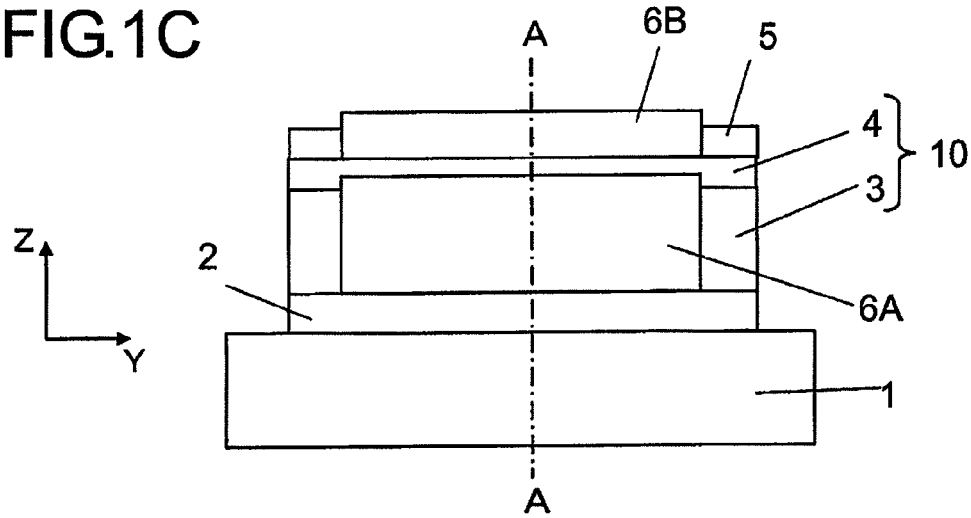

FIG. 1A is a schematic plan diagram of the electron-emitting device, and FIG. 1B is a cross-sectional view taken along A-A line in FIG. 1A (A-A line in FIG. 1C). FIG. 1C is a side view when the electron-emitting device is viewed from a direction of an arrow in FIG. 1B.

An insulating layer 10 and a cathode electrode 2 are arranged adjacent to each other on a substrate 1. The insulating layer 10 is formed by a first insulating layer 3 and, a second insulating layer 4. A step such that a side surface of the second insulating layer 4 is recessed with respect to a side surface of the first insulating layer 3 is formed, so that a recess portion 7 is formed on a side surface (slope) of the insulating layer 10 on the cathode electrode 2 side. The insulating layer 10 can be called also as a step forming member. A gate electrode 5 is provided onto the second insulating layer 4, and an end portion of the gate electrode 5 on the cathode electrode side extends above the recess portion 7. That is to say, the gate electrode 5 is arranged above the recess portion 7, and a lower surface of the gate electrode 5 and an upper surface of the first insulating layer 3 are separated by a predetermined distance (approximately equal to a thickness of the second insulating layer 4). A conductive film 6B is provided onto the gate electrode 5. For this reason, the entire members 5 and 6B can be called as a gate electrode.

A conductive film 6A is arranged on the side surface (slope) of the first insulating layer 3 along the side surface. The conductive film 6A covers the side surface, a corner portion (edge portion) 32 and the upper surface of the first insulating layer 3. That is to say, the conductive film 6A extends from the cathode electrode 2 into the recess portion 7. One end portion of the conductive film 6A is connected to the cathode electrode 2, and the other end portion of the conductive film 6A forms a protruding portion 100 across the inside of the recess portion 7 (the upper surface of the first insulating layer 3 in the recess portion 7) and the side surface (or corner potion 32) of the first insulating layer 3. The protruding portion 100 is arranged on the corner portion 32 of the first insulating layer 3 (a portion where the upper surface and the side surface of the first insulating layer 3 are connected), namely, on an edge of a lower side of the recess portion 7. A tip (front end) of the protruding portion 100 is separated from the surface of the substrate 1 further than the upper surface of the first insulating layer 3 and is pointed.

The arrangement position of the gate electrode 5 is not limited to a mode shown in FIG. 1B. That is to say, the gate electrode may be arranged with a predetermined gap from the protruding portion 100 so as to apply an electric field for enabling field emission to the protruding portion 100. In this case, the second insulating layer 4 is not occasionally necessary. The conductive film 6B is provided onto the gate electrode 5 here, but the conductive film 6B will not be used.

Figure 2:
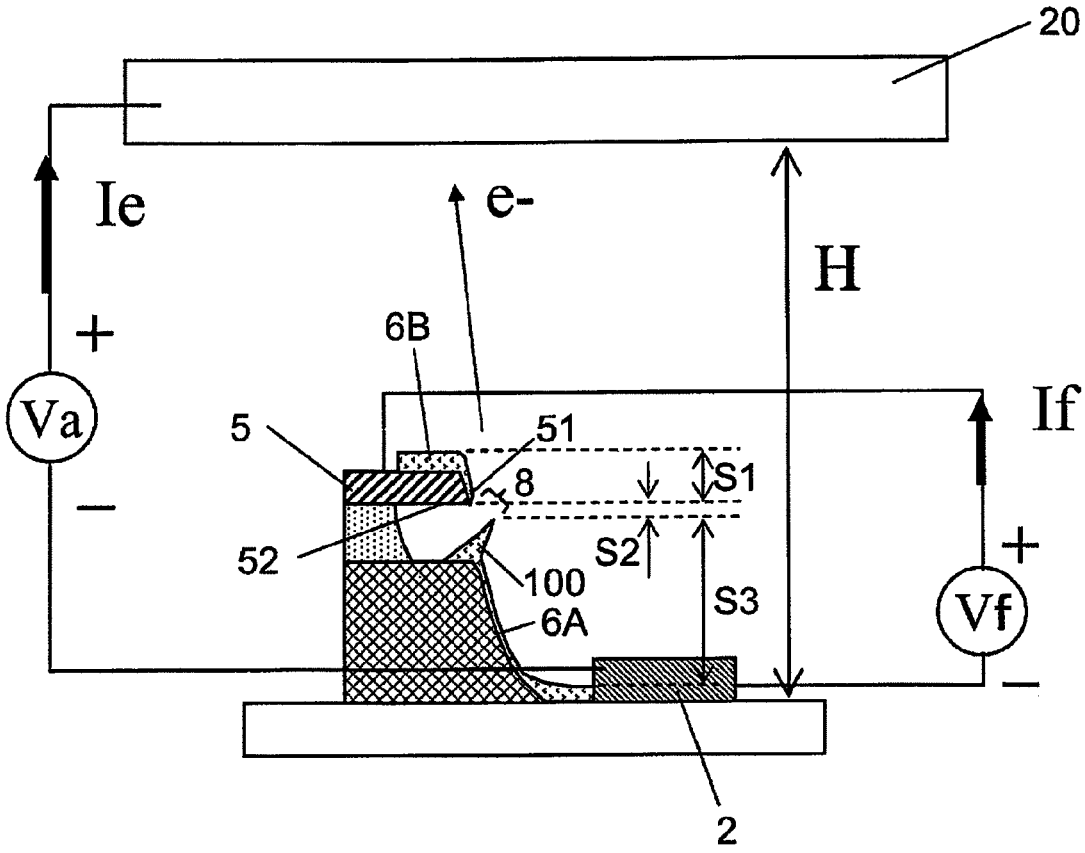
FIG. 2 is a diagram explaining a constitution for measuring an electron emission characteristic.

When a drive voltage is applied between the cathode electrode 2 and the gate electrode 5 so that the electric potential of the gate electrode 5 becomes higher than that of the cathode electrode 2, electrons are field-emitted from the protruding portion 100. That is to say, the protruding portion 100 of the conductive film 6A corresponds to an emitter (cathode). As shown in FIG. 2, an anode electrode 20 whose potential is defined to be higher than that of the gate electrode 5 is arranged above the substrate 1 (a position above further than the gate electrode 5).

The corner portion 32 of the first insulating layer 3 (the edge of the lower side of the recess portion 7) is a portion where the upper surface and the side surface of the first insulating layer 3 are connected (or communicate each other). Further, the corner portion 32 can be said as a portion where the upper surface (side surface) is linked to the side surface (upper surface) of the first insulating layer 3. The corner portion 32 does not have to have curvature (namely, the edge of the upper surface butts against the edge of the side surface), or have curvature. That is to say, the upper surface and the side surface of the first insulating layer 3 may be connected to each other via the portion having a predetermined curvature radius (corner portion 32). When the corner portion 32 has curvature, the conductive film 6A can be formed stably, and thus this is advantageous from a viewpoint of the electron emission characteristic of the electron-emitting device.

(Constitution of the Protruding Portion (Emitter))

The characteristic and desirable mode of the protruding portion 100 of the conductive film 6A are described below with reference to FIGS. 3A and 3B.

A shape of the protruding portion 100 is described in detail with reference to FIGS. 3A and 3B. FIG. 3A is an enlarged diagram of FIG. 1B, and FIG. 3B is an enlarged diagram of an area surrounded by a circular dotted line of FIG. 3A (the protruding portion 100 of the conductive film 6A).

The protruding portion 100 has a wedge shape having a first slope 100A on the recess portion side and a second slope 100B on a side opposite to the recess portion 7 (on a side opposite to the first slope 100A). A lower end (bottom) of the first slope 100A enters the recess portion, and a lower end (bottom) of the second slope 100B is connected to the conductive film 6A on the side surface 33 of the first insulating layer 3. An upper end of the first slope 100A is connected to an upper end of the second slope 100B, so that the tip of the protruding portion 100 is formed. As shown in FIG. 3B, both the first slope 100A and the second slope 100B tilt to an outside of the recess portion 7. That is to say, the protruding portion 100 obliquely extends from the edge (the corner portion 32) of the lower side of the recess portion 7 to the outside of the recess portion 7. In another way, the protruding portion 100 extends (tilts) to a side opposite to the recess portion 7. The tip of the protruding portion 100 protrudes outwards in a horizontal direction with respect to a side end of the gate electrode 5 (a right direction in FIG. 3A). A horizontal distance between the tip of the protruding portion 100 and the side end of the gate electrode 5 is called as an offset amount Dx. A reference symbol d shows a shortest distance between the tip of the protruding portion 100 and the gate electrode 5, and a reference symbol h shows a height of the protruding portion 100 (a height from the upper surface of the first insulating layer 3 to the tip of the protruding portion 100).

Figure 3A:
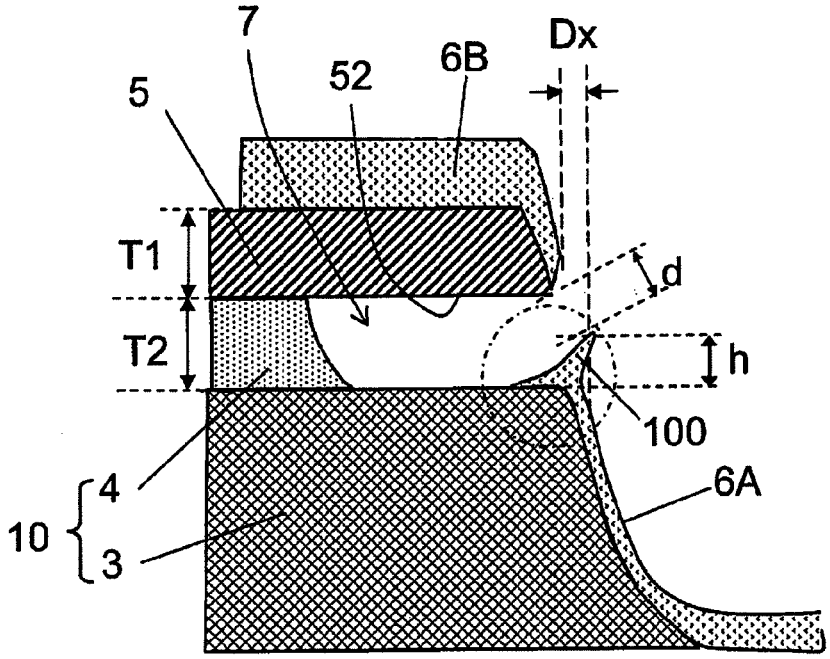
FIGS. 3A and 3B are enlarged diagrams illustrating a vicinity of an electron-emitting portion of the electron-emitting device.
Figure 3B:
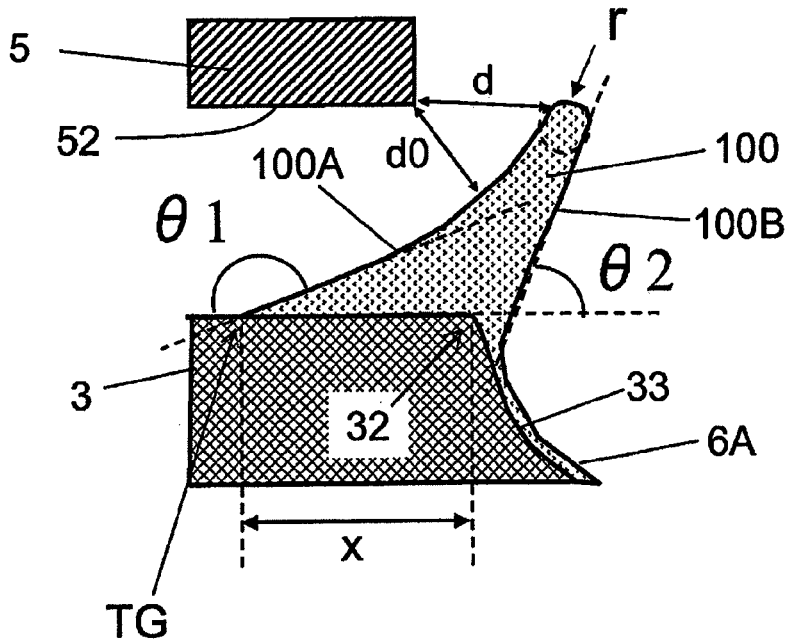

When the tip of the protruding portion 100 is enlarged, a portion represented by a curvature radius r is present at the tip (see a circle shown by a dotted line in FIG. 3B). Electric field strength at the tip of the protruding portion 100 varies according to the curvature radius r. As r is smaller, electric flux lines further concentrate, and thus a high electric field can be applied to the tip of the protruding portion (or a high electric can be formed around the tip of the protruding portion).

On the other hand, when the tip of the protruding portion 100 is separated from the gate electrode 5 (the distance d is increased), scattering of electrons on a rear surface 52 of the gate electrode 5 is decreased, and thus the electron emission efficiency can be improved. As an offset amount Dx increases, the electrons having a trajectory such that the electrons do not collide with the gate electrode 5 (such an electron trajectory is called as a high-efficiency trajectory) increases. As a result, the electron emission efficiency is improved. Further, when the first slope 100A of the protruding portion 100 (the surface opposed to the gate electrode 5) tilt, potential distribution such that the electrons emitted from the tip of the protruding portion 100 easily jump out of the recess portion 7 is formed. As a result, electrons having high-efficiency trajectory further increase. A height h of the protruding portion 100 may be smaller than the height of the recess portion 7 (a thickness T2 of the second insulating layer 4) (see FIG. 3A), and may be the same as or larger than the height of the recess portion 7 (see FIG. 3B).

However, when the offset amount Dx is increased and the first slope 100A is tilted to enter the recess portion 7, a distance d0 between a most proximal portion of the first slope 100A and the gate electrode 5 becomes smaller than a distance d between the tip of the protruding portion 100 and the gate electrode 5. When d>d0, electric field strength of the most proximal portion of the first slope 100A is likely to be larger than electric field strength of the tip of the protruding portion 100. In this case, since electrons are emitted from the first slope 100A, the electrons which scatter on the gate electrode 5 increase. As a result, the electron emission efficiency is deteriorated.

In order to suppress the electron emission from the first slope 100A, the electric field strength E of the tip of the protruding portion 100 may be set to be larger than the electric field strength E0 of the most proximal portion of the first slope 100A. The electric field strength E of the tip of the protruding portion 100 is determined by $(\beta r \times 1/d)Vg$, and the electric field strength E0 of the most proximal portion of the first slope 100A is determined by $(\beta 0 \times 1/d0)Vg$. βr is an electric field enhancement factor according to the shape of the tip of the protruding portion 100, and β0 is an electric field enhancement factor according to the shape of the most proximal portion of the first slope 100A. The electric field enhancement factor is 1 in a planar shape, and becomes larger in a more pointed shape. Vg is a voltage to be applied between the gate electrode 5 and the cathode electrode 2. In order to obtain a relationship E>E0, an emitter shape may be designed so that $(\beta r \times 1/d)Vg > (\beta 0 \times 1/d0)Vg$, namely, $(\beta r/\beta 0) > (d/d0)$. Specifically, in order to make the electric field enhancement factor βr of the tip of the protruding portion 100 larger, the curvature radius r of the tip of the protruding portion 100 may be made to be as small as possible. When the most proximal portion of the first slope 100A is regarded as a plane, the curvature radius r may be set so that $\beta r>(d/d0)$.

Since the lower end of the first slope 100A of the protruding portion 100 should be allowed to enter the recess portion 7, it is not preferable that a tilt angle of the first, slope 100A is changed. In this embodiment, the side surface of the protruding portion 100 on the cathode electrode side is gouged so that the second slope 100B is tilted to the same direction as that of the first slope 100A. That is to say, as shown in FIG. 3B, the second slope 100B is formed so that an angle θ2 formed by the second slope 100B and the upper surface of the first insulating layer 3 (the surface of the substrate 1) becomes smaller than 90°. As a result, the angle formed by the first slope 100A and the second slope 100B becomes small, and thus the curvature radius r of the tip of the protruding portion 100 can be small.

When the above emitter shape is adopted, the electron emission from the tip of the protruding portion 100 is dominant so that the high electron emission efficiency can be realized.

The protruding portion 100, as shown in FIG. 3B, enters the recess portion 7 by a distance x from the corner portion 32. As a result, the following three advantages are derived.

(1) The protruding portion 100 to be the electron-emitting portion contacts with the first insulating layer 3 at a wide area, so that a mechanical adhesion force is strengthened (rise in the adhesion strength).

(2) A thermal contact area between the protruding portion 100 to be the electron-emitting portion and the first insulating layer 3 is widened, so that heat generated at the electron-emitting portion can be allowed to escape to the first insulating layer 3 efficiently (reduction in thermal resistance).

(3) The protruding portion is inclined with respect to the upper surface of the first insulating layer 3, so that the electron field strength at a triple point (TG in FIG. 3B) of the insulating layer, vacuum and a metal interface is weakened. As a result, a discharge phenomenon due to abnormal of the electric field can be prevented.

(Description of the Electron Emission Efficiency)

FIG. 2 is a diagram illustrating a relationship between a power source and an electric potential at the time of measuring the electron-emitting characteristic of the electron-emitting device. "Vf" shows a voltage to be applied between the cathode and the gate, "If" shows a device current to be flowing at this time, "Va" shows a voltage to be applied between the cathode and the anode electrode 20, and "Ie" shows an electron emission current. The electron emission efficiency (η) is obtained according to the efficiency η=Ie/(If+Ie) by using the electric current (If) detected and the electric current (Ie) taken out into vacuum at the time of applying the voltage (Vf) to the device.

(Description about Scattering in the Electron Emission)

In FIG. 2, some of the electrons emitted from the protruding portion 100 to the gate electrode 5 collide with the gate electrode 5, and the other electrons do not collide with the gate electrode 5. Portions of the gate electrode 5 with which the electrons collide are approximately a side surface 51 of the gate electrode 5 and a lower surface 52 of the gate electrode 5 (the surface exposed in the recess portion 7). Most of the electrons collide with the side surface 51. On any one of the side surface 51 and the lower surface 52 as the colliding portion, the electrons which collide with the gate electrode 5 are scattered isotropically. However, which surface the electrons are scattered on greatly influence the efficiency. When the tip of the protruding portion 100 is separated from the gate electrode 5 as far as possible, namely, the offset amount Dx and the distance d are increased, the scattering of the electrons on the lower surface 52 of the gate electrode 5 is reduced so that the electron emission efficiency can be improved.

A lot of electrons scattered on the gate electrode 5 are elastically scattered (multiply scattered) on the gate electrode 5 in a repetitive manner. The electrons cannot be scattered on the upper portion of the gate electrode 5 and jump out to the anode side. The efficiency is improved by reducing the number of scattering times of the electrons on the gate electrode 5 (the number of falling times).

The number of scattering times and the distance are described with reference to FIG. 2. A potential area of the electron-emitting device includes a high-potential area and a low-potential area between which a gap 8 is present. The high-potential area is determined by a voltage to be applied to the gate electrode 5. The low-potential area is determined by a voltage to be applied to the cathode electrode 2 and the conductive film 6A. Reference symbols S1, S2 and S3 in FIG. 2 show area lengths determined by electric potentials of the gate and the cathode, and they are different from simple thicknesses of the electrode and the insulating layer.

When the voltage Vf is applied between the gate and the cathode of the electron-emitting device, electrons are emitted from the front end of the low-potential area to the high-potential area, and the electrons scatter isotropically at the end portion of the high-potential area. Most of the electrons which scatter at the end portion of the high-potential area are elastically scattered on the high-potential area in a repetitive manner at one to several times.

In this constitution, as a result of detailed examination of the scattering, the following becomes clear. There are conditions in which the efficiency can be improved, and the conditions are obtained by a function of the drive voltage Vf and a work function ϕwk of a material used for the gate electrode (or a member having the same potential connected to the gate electrode) forming the high-potential area, as well as by a function of the distances S1 and S3, namely, an effect of the shape of the vicinity of the emitting portion.

As a result of the analytic examination, the following formula relating to S1max (a total thickness of the gate electrode 5 and the conductive film 6B) is derived.

$$S1\max = A\times\exp[B\times(Vf-\phi wk)/(Vf)]$$

$$A=-0.78+0.87\times\log(S3)$$

$$B=\mathbf{8.7} \qquad (3)$$

S1 and S3 are distances (unit: nm), ϕwk is a value of the work function of the gate electrode (or the member having the same potential connected to the gate electrode) forming the high-potential area (unit: eV), Vf is a drive voltage (unit: V), A is a function of S3, and B is a constant.

S1 as a parameter relating to the scattering is important for the electron emission efficiency, and when S1 is set to a value which satisfies the formula (3), the efficiency can be noticeably improved.

Since the electron emission efficiency can be improved by the emitter shape as shown in FIG. 3B, if the required efficiency is a constant condition, S1 in the formula (3) can be set to be large. That is to say, the gate electrode 5 can be made to be thicker than a conventional one by using the emitter shape in this embodiment. As a result, the gate structure can be strengthened, so that the stable device which can withstand a long-time driving can be provided.

(Method for Manufacturing the Electron-Emitting Device)

One example of the method for manufacturing the electron-emitting device according to the embodiment of the present invention is described with reference to FIGS. 4A to 4G. FIGS. 4A to 4G are schematic diagrams sequentially illustrating steps of manufacturing the electron-emitting device according to the embodiment of the present invention. FIGS. 3A and 3B are used for the description about the detailed shape of the electron-emitting portion.

(Step 1)

The substrate 1 is a substrate which supports the electron-emitting device. As the substrate 1, quartz glass, glass where a contained amount of impurity such as Na is reduced, or soda-lime glass can be used. The substrate 1 is preferably made of an insulating material. The functions necessary for the substrate 1 include not only high mechanical strength but also resistance properties against dry etching, wet etching, and alkali and acid of a developer or the like. When the substrate 1 is used for an image display apparatus, since it undergoes a heating step, the substrate 1 desirably has coefficient of thermal expansion is less different from that of a member to be laminated. In view of the thermal treatment, a material in which an alkaline element difficultly diffuses from the inside of the glass into the electron-emitting device is desirable.

Figure 4A:
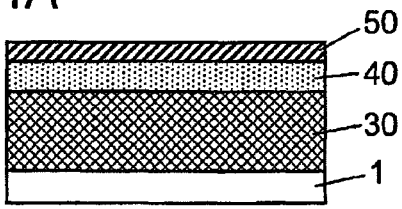
FIGS. 4A to 4G are diagrams explaining one example of a method for manufacturing the electron-emitting device.

An insulating layer 30 to be the first insulating layer 3 is formed on the surface of the substrate 1, and an insulating layer 40 to be the second insulating layer 4 is laminated on the upper surface of the insulating layer 30. A conductive layer 50 to be the gate electrode 5 is laminated on an upper surface of the insulating layer 40 (FIG. 4A). A material of the insulating layer 40 is selected differently from a material of the insulating layer 30 so that an amount of etching using an etching liquid (etchant) used at step 3, described later, on the insulating layer 40 becomes larger than that of the insulating layer 30.

The insulating layer 30 (first insulating layer 3) is made of a material with excellent workability, and its example includes silicon nitride (typically $Si_3N_4$) and silicon oxide (typically $SiO_2$). The insulating layer 30 can be formed by a general vacuum deposition method such as a sputtering method, a CVD (chemical vapor deposition) method, or a vacuum evaporation method. A thickness of the insulating layer 30 is set within a range of a several nm to several dozen μm, and preferably within a range of several dozen nm to several hundred nm.

The insulating layer 40 (second insulating layer 4) is made of a material with excellent workability, and this example includes silicon nitride (typically $Si_3N_4$) and silicon oxide (typically $SiO_2$). The insulating layer 40 can be formed by the general vacuum deposition method such as the sputtering method, the CVD method, or the vacuum evaporation method. A thickness of the insulating layer 40 is thinner than the insulating layer 30, and is set within a range of a several nm to several hundred nm, and preferably a several nm to several dozen nm.

After the insulating layers 30 and 40 are laminated on the substrate 1, the recess portion 7 should be formed at step 3. For this reason, in the second etching process, an etching amount on the insulating layer 40 is larger than that on the insulating layer 30. Desirably a ratio of the etching amount between the insulating layers 30 and 40 is 10 or more, and more preferably 50 or more.

In order to obtain such a ratio of the etching amount, the insulating layer 30 may be formed by a silicon nitride film, and the insulating layer 40 maybe composed of a silicon oxide film, PSG whose phosphorus density is high or a BSG film whose boron density is high. PSG is phosphorus silicate glass, and BSG is boron silicate glass.

The conductive layer 50 (gate electrode 5) has conductivity, and is formed by the general vacuum deposition technique such as the evaporation method and the sputtering method.

A material of the conductive layer 50 to be the gate electrode 5 desirably has conductivity, high thermal conductivity, and high melt point. Metal such as Be, Mg, Ti, Zr, Hf, V, Nb, Ta, Mo, W, Al, Cu, Ni, Cr, Au, Pt or Pd, or a metal alloy material thereof can be used. Further, carbide, boride or nitride can be used, or semiconductor such as Si or Ge can be also used.

A thickness of the conductive layer 50 (gate electrode 5) is set within a range of a several nm to several hundred nm, and preferably within a range of several dozen nm to several hundred nm. Since a film thickness of the conductive layer 50 to be the gate electrode 5 is occasionally set to be thinner than the cathode electrode 2, the conductive layer 50 is desirably made of a material with lower resistance than that of the cathode electrode 2.

(Step 2)

An etching process for the conductive layer 50, the insulating layer 40 and the insulating layer 30 (first etching process) is executed.

Figure 4B:
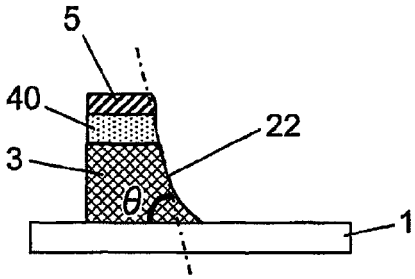

Specifically, the first etching process is a process for etching the conductive layer 50, the insulating layer 40 and the insulating layer 30 after forming a resist pattern on the conductive layer 50 by using a photolithography technique. At step 2, the first insulating layer 3 and the gate electrode 5 composing the electron-emitting device shown in FIG. 3B are formed basically (FIG. 4B). As shown in FIG. 4B, it is preferable that an angle (θ) formed by the side surface (slope) 22 of the first insulating layer 3 formed at this step and the surface of the substrate 1 becomes smaller than 90°.

The first etching process preferably uses RIE (Reactive Ion Etching) in which etching gas is converted into plasma and is emitted to the material, so that the material can be etched precisely.

When a member to be processed is made of a material for forming fluoride, fluorine gas such as $CF_4$, $CHF_3$ or $SF_6$ is selected as the gas used for RIE. When the member to be processed is made of a material forming chloride such as Si or Al, chlorine gas such as $Cl_2$ or $BCl_3$ is selected. In order to obtain a selected ratio with respect to resist and in order to secure smoothness on an etching surface or heighten an etching speed, at least any one of hydrogen, oxygen and argon gas is added to etching gas.

(Step 3)

Figure 4C:
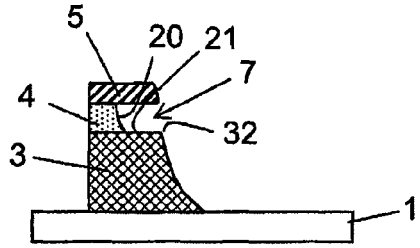

An etching process (second etching process) for the insulating layer 40 is executed (FIG. 4C). As a result, the recess portion 7 is formed on the side surface (slope) of the insulating layer.

At the second etching process, when the insulating layer 40 is formed by silicon oxide and the first insulating layer 3 (insulating layer 30) is formed by silicon nitride, so-called buffered hydrogen fluoride (BHF) may be used as the etching liquid. The buffered hydrogen fluoride (BHF) is a mixed solution of ammonium fluoride and hydrofluoric acid. Further, when the insulating layer 40 is formed by silicon nitride and the first insulating layer 3 (insulating layer 30) is formed by silicon oxide, hot phosphoric acid etching liquid may be used as etchant.

A depth of the recess portion 7 (distance in a widthwise direction) deeply relates to a leak current of the electron-emitting device. As the recess portion 7 is made to be deeper, the value of the leak current becomes smaller. However, when the recess portion 7 is too deep, a problem such that the gate electrode 5 is deformed arises. For this reason, the depth is practically set to not less than 30 nm and not more than 200 nm.

(Step 4)

Figure 4D:
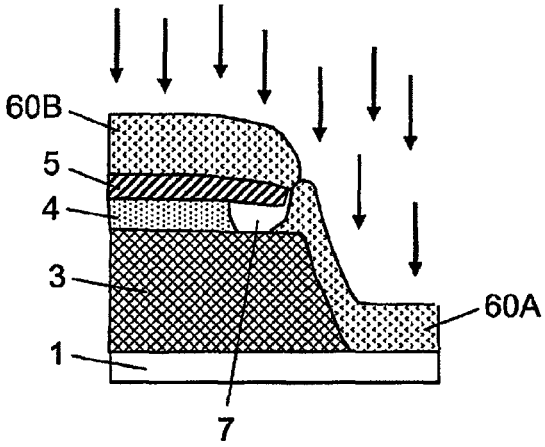

A film 60A made of a material composing the conductive film (6A) is deposited so as to cover from the surface of the substrate 1, via the slope 22 to be the side surface of the first insulating layer 3 on the cathode electrode 2 side, to the upper surface 21 of the first insulating layer 3. At the same time, the film 60B made of the material composing the conductive film (6B) is deposited on the gate electrode 5. In such a manner, the conductive films 60A and 60B are formed (FIG. 4D).

The material of the conductive films (60A and 60B) may be a conductive and field emission material, and preferably a material with high melt point of 2000° C. or more is selected. The material of the conductive film 60A is a material with low work function of 5 eV or less, and preferably a material of which oxide can be easily etched. Examples of the material include metal such as Hf, V, Nb, Ta, Mo, W, Au, Pt or Pd, metal alloy, carbide, boride and nitride thereof. At step 5, a process for etching a surface oxide film using a difference in an etching property between the metal and the metal oxide is occasionally executed, Mo or W is preferably used as the material of the conductive films (60A and 60B) The conductive films (60A, 60B) are formed by the general vacuum deposition technique such as the evaporation method and the sputtering method.

(Step 5)

An etching process (third etching process) for the conductive films (60A and 60B) is executed. As the main aim of the third etching process, the conductive films (60A and 60B) are etched in a film thickness direction.

Figure 4E:
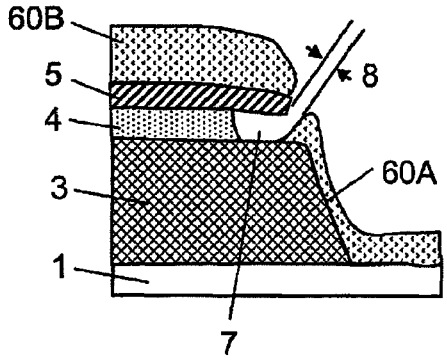
Figure 4F:
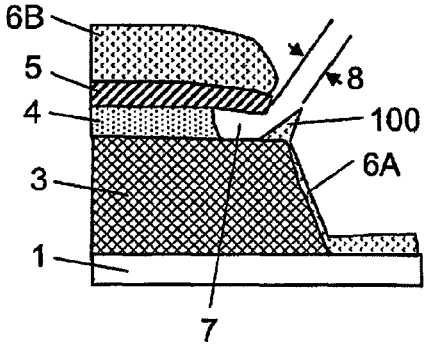

At step 5, a gap 8 is formed between the conductive films 60A and 60B which contact with each other at step 4. Further, the end portion (protruding portion 100) of the conductive film 60A can be pointed. Unnecessary conductive materials (materials composing the conductive films (60A and 60B)) which are attached into the recess portion can be removed. As a result, the conductive films 6A and 6B are formed (FIGS. 4E and 4F).

In order to form the optimum shape (see FIG. 3B) of the protruding portion 100 for efficient electron emission, an evaporation angle, deposition time, and temperature and degree of vacuum at the time of formation are controlled. Specifically, the entering amount x of the protruding portion 100 into the recess portion 7 is 10 nm to 60 nm, more preferably 20 nm to 30 nm. An angle (θ1 in FIG. 3B) between the upper surface of the first insulating layer 3 and the first slope 100A of the protruding portion 100 is set to be larger than 90° and smaller than 180°. Further, an angle (θ2 in FIG. 3B) between the upper surface of the first insulating layer 3 (the surface of the substrate 1) and the second slope 100B is set to be smaller than 90°, more preferably, 80° or less to 60° or more. When the shape of the protruding portion 100 as the emitter (the entering amount x, the angles θ1 and θ2) is set within the above range, mechanical strength is maintained, and simultaneously the curvature radius r of the tip of the protruding portion 100 can be sufficiently small. As a result, high-electron emission efficiency can be realized.

In order to obtain a more preferable shape of the protruding portion 100, in addition to the third etching process, dry etching is preferably performed.

(Step 6)

Figure 4G:
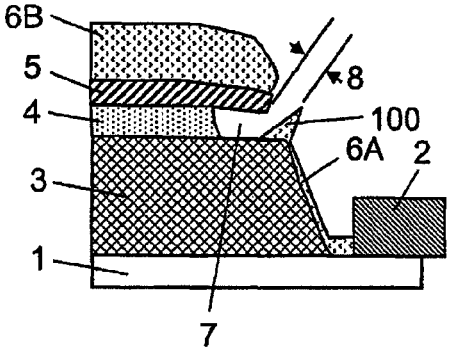

The cathode electrode 2 for supplying electrons to the conductive film 6A is formed (FIG. 4G). This step can be moved to before or after the other steps. The cathode electrode 2 is not used, and the conductive film (cathode) 6A can fulfill the function of the cathode electrode 2. In this case, step 6 is omitted.

The cathode electrode 2 has conductivity similarly to the gate electrode 5, and can be formed by the general vacuum deposition technique such as the evaporation method and the sputtering method, and the photo lithography technique. The material of the cathode electrode 2 may be the same as or different from that of the gate electrode 5. The thickness of the cathode electrode 2 is set within a range of several dozen nm to a several μm, and preferably within a range of several hundred nm to a several μm.

Basically, at steps 1 through 6, the electron-emitting device shown in FIGS. 3A and 3B can be formed.

Figure 5A:
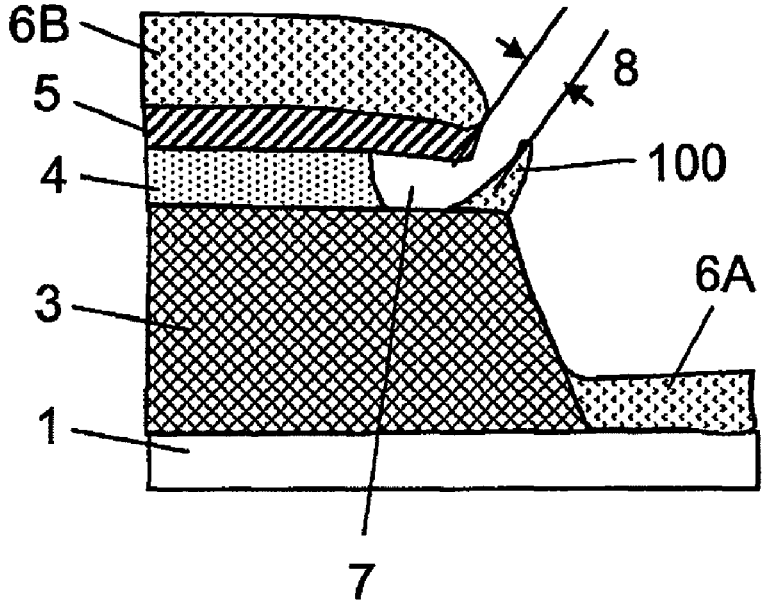
FIGS. 5A and 5B are diagrams explaining one example of the method for manufacturing the electron-emitting device.

The portion positioned on the side surface of the first insulating layer 3 of the conductive film 6A occasionally has too high resistance or most of that portion is occasionally removed due to the third etching process at step 5 (FIG. 5A). Therefore, the following step 7 can be further added.

(Step 7)

Figure 5B:
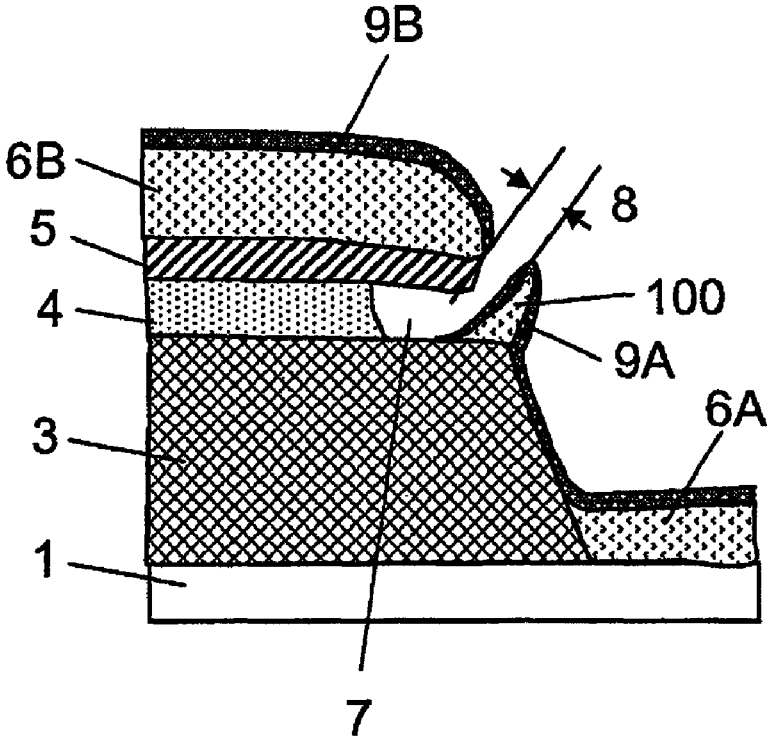

After step 5 or 6, a conductive material is deposited on at least on the side surface of the first insulating layer 3 (if the conductive film 6A remains on the side surface, on that side surface), so that a coating film 9A is formed. The coating film 9A may be formed by the same material as the conductive film 6A, or by another material (FIG. 5B). At this step, a coating film 9B is occasionally provided also on the conductive film 6B.

When the film made of a low-work function material is used as the coating film 9A, it is provided onto the slope of the first insulating layer 3, and further at least the end of the protruding portion 100 is coated with the coating film 9A. As the low-work function material, a film made of material with lower work function than that of the conductive film 6A may be used. For example, an n-type diamond film, a tetrahedral amorphous carbon (ta-C) film dope with nitrogen, or an yttrium oxide film may be suitably used.

(Constitution of the Image Display Apparatus)

The image display apparatus having an electron source obtained by arranging the plurality of electron-emitting devices is described below with reference to FIGS. 9 and 10.

Figure 9:
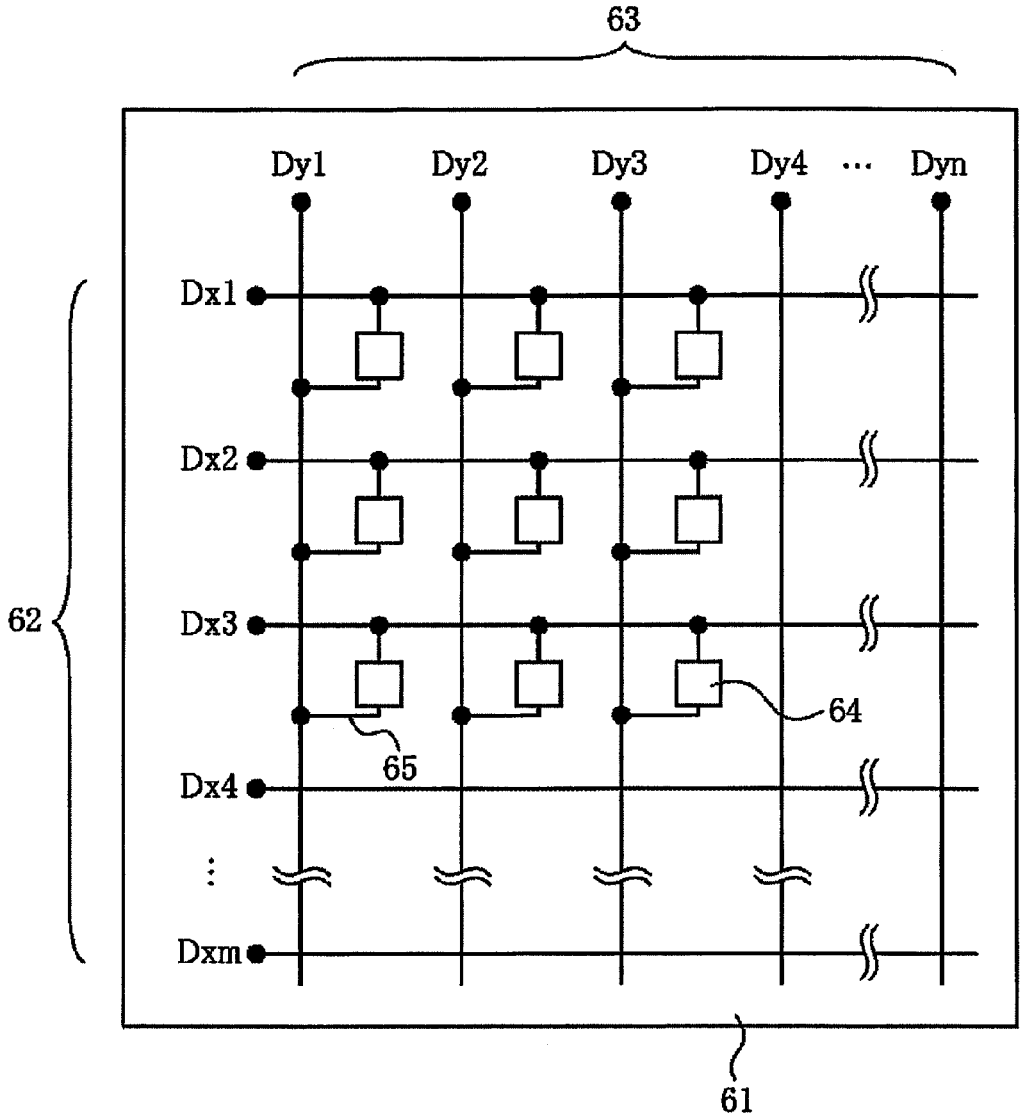
FIG. 9 is an explanatory diagram illustrating an electron source where the electron-emitting devices are arranged.

In FIG. 9, reference numeral 61 is a substrate, 62 is an X-direction wiring, and 63 is a Y-direction wiring. Reference numeral 64 is the electron-emitting device, and 65 is wire connection. The X-direction wiring 62 is a wiring connected to the cathode electrodes 2 commonly, and the Y-direction wiring 63 is a wiring connected to the gate electrodes 5 commonly.

The r-numbered X-direction wirings 62 are composed of DX1, DX2, . . . DXm, and can be composed of a conductive material such as metal formed by the vacuum evaporation method, a printing method or the sputtering method. The material, a thickness and a width of the wirings are suitably designed.

The n-numbered Y-direction wirings 63 are composed of DY1, DY2, . . . DYn, and are formed similarly to the X-direction wirings 62. An interlayer insulating layer, not shown, is provided between the r-numbered X-direction wirings 62 and the n-numbered Y-direction wirings 63, and they are electrically separated (m and n are positive integers).

The interlayer insulating layer, not shown, is formed by using the vacuum evaporation method, the printing method or the sputtering method. The interlayer insulating layer is formed into a desired shape on whole or part of the surface of the substrate 61 formed with the X-direction wirings 62. The thickness, the material and the manufacturing method are suitably set as to be capable of withstanding particularly a potential difference on a cross portion between the X-direction wirings 62 and the Y-direction wirings 63. The X-direction wirings 62 and the Y-direction wirings 63 are drawn as external terminals.

As to the materials composing the wirings 62 and 63, the material composing the wire connection 65, and the materials composing the cathode and the gate, some or all of their constituent elements may be the same or different.

A scan signal application unit, not shown, which applies a scan signal for selecting a row of the electron-emitting devices 64 arranged in the X direction is connected to the X direction wirings 62. On the other hand, a modulation signal generating unit, not shown, which generates modulation signals to be supplied to the electron-emitting devices 64 on the respective rows according to an input signal is connected to the Y direction wirings 63.

The drive voltage to be applied to each electron-emitting device is supplied as a difference voltage of the scan signal and the modulation signal applied to the device.

In the above constitution, the individual devices are selected by using a simple matrix wiring so as to be capable of being driven individually.

The image display apparatus constituted by using the electron source of the simple matrix arrangement is described with reference to FIG. 10. FIG. 10 is a diagram illustrating one example of an image display panel 77 of the image display apparatus.

Figure 10:
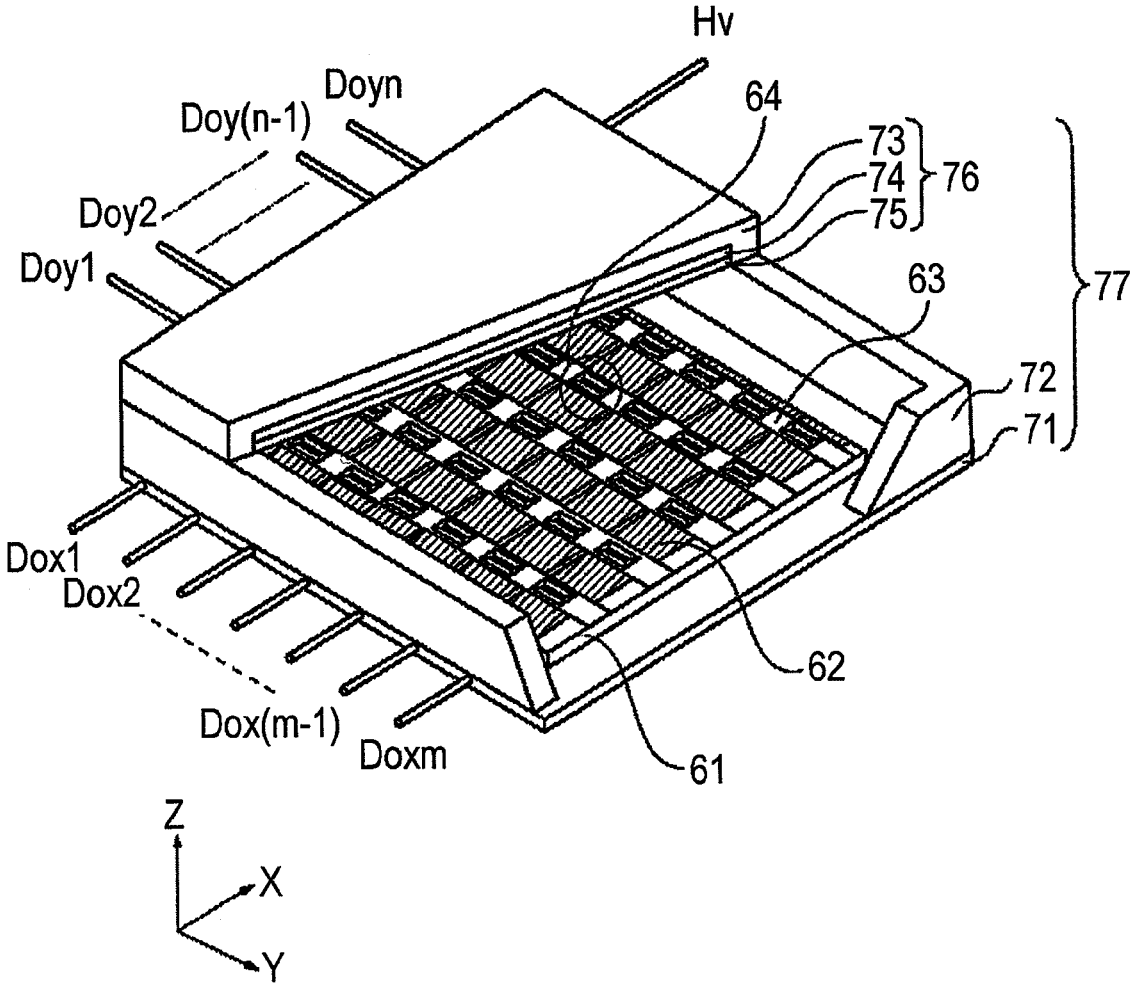
FIG. 10 is an explanatory diagram illustrating an image display apparatus using the electron-emitting device.

In FIG. 10, reference numeral 61 is a substrate where a plurality of electron-emitting devices is arranged, and 71 is a rear plate which fixes the substrate 61. Reference numeral 76 is a face plate where a metal back 75 as an anode and a fluorescent substrate film as a film 74 of a light-emitting member are formed on an inner surface of a glass substrate 73.

Reference numeral 72 is a supporting frame, and the rear plate 71 and the face plate 76 are sealed (bonded) into the supporting frame 72 by using a bonding material such as frit glass. Reference numeral 77 is an envelope, and it is formed by calcining for 10 or more minutes within a temperature range of 400 to 500° C. in air or nitrogen and sealing.

Further, reference numeral 64 corresponds to the electron-emitting device in FIG. 1A, and 62 and 63 are the X direction wirings and the Y direction wirings which are connected to the cathode electrodes 2 and the gate electrodes 5 of the electron-emitting devices, respectively. FIG. 10 schematically illustrates a positional relationship between the electron-emitting devices 64 and the wirings 62 and 63. Actually, the electron-emitting devices 64 are arranged on the substrate beside the cross portions between the wirings 62 and 63.

The image display panel 77 is composed of the face plate 76, the supporting frame 72 and the rear plate 71. Since the rear plate 71 is provided in order to mainly heighten the strength of the substrate 61, when the substrate 61 itself has sufficient strength, the rear plate 71 is unnecessary.

That is to say, the supporting frame 72 is sealed directly to the substrate 61, and the supporting frame and the face plate 76 may be sealed so as to compose the envelope 77. Further, a supporter, not shown, which is called as a spacer may be provided between the face plate 76 and the rear plate 71 to obtain the image display panel 77 having sufficient strength against atmosphere pressure.

The display panel 77 is connected to an external electric circuit via terminals Dox1 to Doxm, terminals Doy1 to Doyn, and a high-voltage terminal Hv.

A scan signal is applied to the terminals Dox1 to Doxm. The scan signal drives the electron source provided in the display panel 77, namely, the electron-emitting devices arranged into a matrix pattern and into m rows×n columns line by line (per N devices).

On the other hand, a modulation signal for controlling the output electron beams of the respective electron-emitting devices on one row selected by the scan signal is applied to the terminals Doy1 to Doyn.

A DC voltage of 10 [kV] is supplied to the high-voltage terminal Hv by the DC voltage source Va.

The emitted electrons are accelerated by the scan signal, the modulation signal and the high-voltage application to the anode to irradiate the fluorescence substance, so that an image is displayed.

EXAMPLES

More detailed examples are described below based on the above embodiment.

Example 1

A method of manufacturing the electron-emitting device in the example 1 is described with reference to FIGS. 4A to 4F.

High-strain point low-sodium glass (PD200 made by Asahi Glass Co., Ltd.) was used as the substrate 1.

At first, the insulating layers 30 and 40 and the conductive layer 50 were laminated on the substrate as shown in FIG. 4A.

The insulating layer 30 was an insulating film made of a material with excellent workability, silicon nitride ($Si_3N_4$), and was formed by the sputtering method so as to have a thickness of 500 nm.

The insulating layer 40 was an insulating film made of a material with excellent workability, silicon oxide ($SiO_2$), and was formed by the sputtering method so as to have a thickness of 30 nm.

The conductive layer 50 was composed of a tantalum nitride (TaN) film, and was formed by the sputtering method into a thickness of 30 nm.

As shown in FIG. 4B, after a resist pattern was formed on the conductive layer 50 by the photolithography technique, the conductive layer 50, the insulating layer 40 and the insulating layer 30 were worked sequentially by using the dry etching method. The conductive layer 50 was patterned by the first etching process to become the gate electrode 5, and the insulating layer 30 was patterned so as to become the first insulating layer 3.

As processed gas at this time, $CF_4$ type gas was used for the insulating layers 30 and 40 and the conductive layer 50. As a result of executing RIE using this gas, the angle of the side surfaces of the insulating layers 30 and 40 and the gate electrode 5 after etching was formed to be about 80° with respect to the surface of the substrate (horizontal surface).

After the resist was peeled, as shown in FIG. 4C, the insulating layer 40 was etched to form the recess portion 7 with a depth of about 100 nm by using BHF (high-purity buffered hydrogen fluoride LAL 100 made by Stella Chemifa Corporation). At this second etching process, the recess portion 7 was formed on the step forming member 10 composed of the insulating layers 3 and 4.

As shown in FIG. 4D, molybdenum (Mo) was adhered to the slope and the upper surface (the inner surface of the recess portion) of the first insulating layer 3, and the gate electrode 5, so that the conductive films 60A and 60B were formed simultaneously. At this time, as shown in FIG. 4D, the conductive films 60A and 60B were deposited so as to contact with each other.

In this embodiment, the sputtering method was used as the deposition method. The angle of the surface of the substrate 1 was set to be horizontal with the sputtering target. A shielding plate was provided between the substrate 1 and the target so that the sputtered particles entered the surface of the substrate 1 at a limited angle (specifically, the angle formed by the incident direction of the sputtered particles and the normal line of the surface of the substrate 1 falls within 0±10°). Further, argon plasma was created with power of 3 kW and vacuum of 0.1 Pa, and the substrate 1 was arranged so that a distance between the substrate 1 and the Mo target became 60 mm or less (mean free path at 0.1 Pa). The Mo film was formed at the evaporation speed of 10 nm/min so that the thickness of Mo on the slope of the insulating layer 3 became 60 nm.

At this time, the conductive film 60A was formed so that an entering amount of the conductive film into the recess portion 7 (a distance x in FIG. 3B) became 35 nm, and the angle (θ1 in FIG. 3B) between the inner surface of the recess portion 7 (the upper surface of the insulating layer 3) and the protruding portion became 110°.

Observation using TEM (transmission electron microscope) and analysis using EELS (electron energy-loss spectroscope) were carried out. The film density of Mo was calculated based on the results. As a result, the portions with high film density (corresponding to 6A1 and 6B1 in FIG. 6) were 10.0 g/cm$^3$, and the portions with low film density (corresponding to 6A2 and 6B2 in FIG. 6) were 7.8 g/cm$^3$.

Figure 7A:
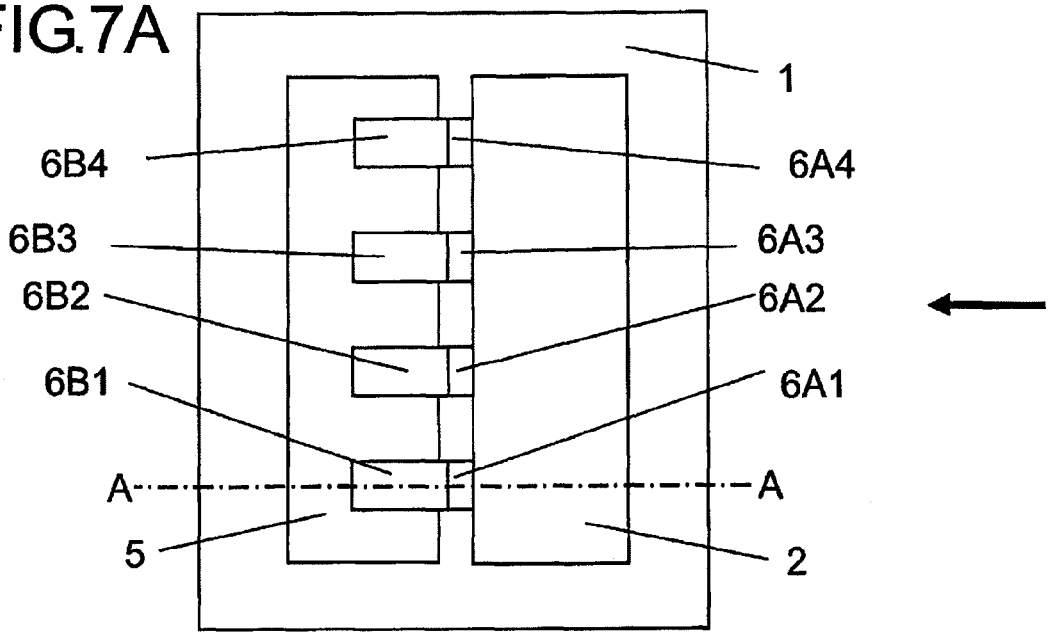
FIGS. 7A to 7C are diagrams illustrating one example of the constitution of the electron-emitting device having a plurality of protruding portions (conductive films)
Figure 7B:
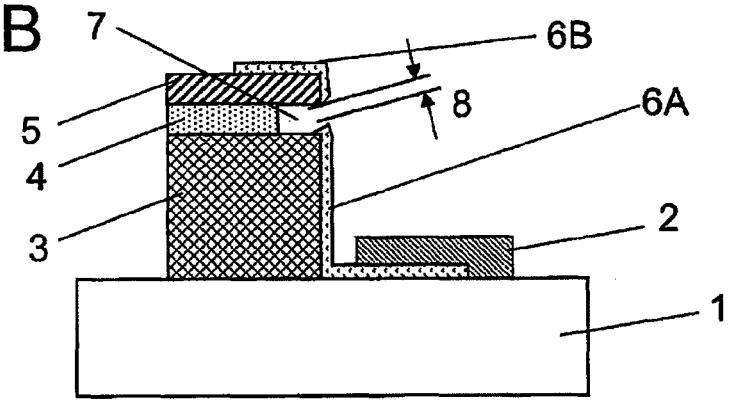
Figure 7C:
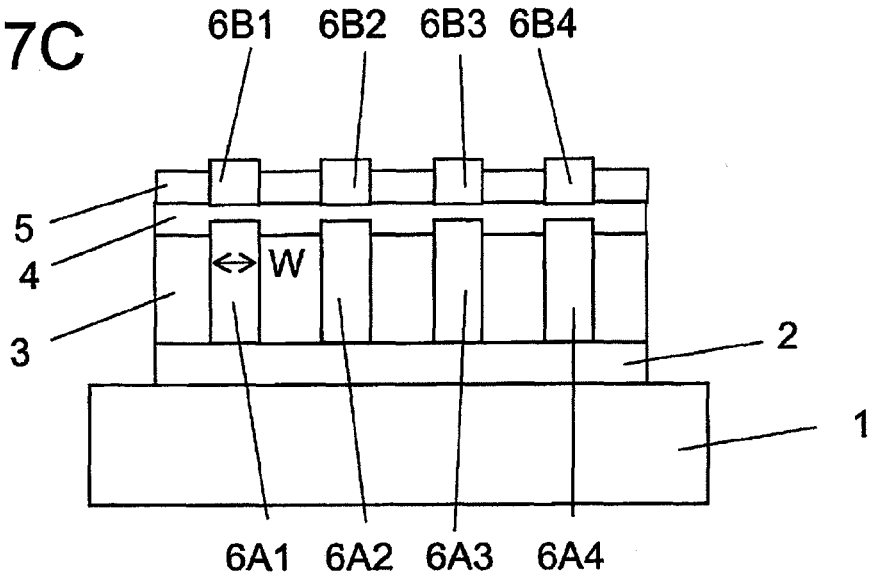

As shown in FIGS. 7A to 7C, the conductive films 60A and 60B made of Mo were subject to the patterning process for dividing them into a plurality of pieces.

A resist pattern was formed by the photolithography technique so that widths W of the conductive films 6A1 to 6A4 (FIG. 7C) became lines and spaces of 3 μm, and a total width of lines and spaces became 100 μm. Thereafter, the reed-shaped conductive films 6A1 to 6A4 and the reed-shaped conductive films 6B1 to 6B4 were formed by using the dry etching method. Since molybdenum is a material for creating fluoride, $CF_4$ type gas was used as the processed gas at this time.

At this stage, as shown in FIG. 4D, the reed-shaped conductive film 60A (conductive films 6A1 to 6A4) and the reed-shaped conductive film 60B (conductive films 6B1 to 6B4) contacted with each other.

As shown in FIG. 4E, the reed-shaped conductive film 60A (conductive films 6A1 to 6A4) and the reed-shaped conductive film 60B (conductive films 6B1 to 6B4) were subject to the etching process (third etching process) in order to form the gap to be the electron-emitting portion.

This etching process included a step of oxidizing the surfaces of the conductive film 60A (conductive films 6A1 to 6A4) and the conductive film 60B (conductive films 6B1 to 6B4) made of Mo, and a step of removing the oxidized surfaces.

Specifically, in the method of oxidizing Mo, 350 mJ/cm$^2$ of excimer UV (wavelength: 172 nm, illuminance: 18 mw/cm$^2$) was emitted in atmosphere by using an excimer UV exposing apparatus. Under this condition, an oxide layer was formed on the surfaces of the conductive film 60A (conductive films 6A1 to 6A4) and the conductive film 60B (conductive films 6B1 to 6B4) so as to be the thickness of about 3 nm on the slopes with low film density and the thickness of about 1 to 2 nm on the portion with high film density. Thereafter, the substrate 1 was soaked into warm water (45° C.) for 5 minutes so that the molybdenum oxide layer was removed. The cycle including the oxidizing step using excimer UV (emission with 350 mJ/cm$^2$) and the step of removing the oxidized film using warm water (soaking at 45° C. for 5 minutes) was executed at three times.

At this step, the conductive film 60A (conductive films 6A1 to 6A4) and the conductive film 60B (conductive films 6B1 to 6B4) were separated. And since the etching rates differed due to difference of the film density of Mo shown in FIG. 6, the end portion of the conductive film 60A (conductive films 6A to 6A4) was formed into a protruding shape (FIG. 4E).

A process for pointing the end shape of the protruding portion of the conductive film 60A by dry etching was executed. Pressure in the apparatus was set to 4 Pa by using a mixed gas of 40 sccm of $CF_4$ and 160 sccm of Ar, and a power of 400 w was introduced, and the process was executed for 90 seconds. As a result, the protruding portion 100 had a preferable shape (FIG. 4F). The angle of the second slope 100B of the protruding portion 100 (θ2 in FIG. 3B) could be smaller than 90° by this process. θ2 can be controlled by the process time, the power and the mixing ratio. The dry etching was used for making θ2 smaller than 90°, but θ2 smaller than 90° can be obtained by providing a mask to a non-etching portion (a portion which is not etched) and executing a wet etching process.

As a result of the analysis using a cross-section TEM, as shown in FIG. 4F, the shortest distances 8 between the protruding portions 100 to be the electron-emitting portions of the conductive film 6A (conductive films 6A1 to 6A4) and the gate electrode 5 were averagely 20 nm. The angles of the second slopes 100B of the protruding portions 100 (θ2 in FIG. 3B) were 75°.

As shown in FIG. 4G, the electrode 2 was formed. Copper (Cu) was used for the electrode 2. The electrode 2 was formed by the sputtering method, and its thickness was 500 nm.

After the electron-emitting device was formed by the above method, the characteristics of the electron-emitting device were evaluated by the constitution shown in FIG. 2.

In the evaluation of the characteristics, the potential of the gate electrode 5 (and the conductive films 6B1 to 6B4) was set to 30 V, and the potentials of the conductive films 6A1 to 6A4 were defined as 0 V via the electrode 2. As a result, a drive voltage of 30 V was applied between the gate electrode 5 and the conductive films 6A1 to 6A4. As a result, in the electron-emitting device, the average electron-emitting current Ie was 6 μA, and the average electron emission efficiency was 18%.

In an image display apparatus using the electron-emitting devices, a display apparatus having excellent formability of an electron beam can be provided. Further, the display apparatus which provides satisfactory display images can be realized, and the image display apparatus of low power consumption due to improved efficiency can be provided.

Comparative Example

Figure 8:
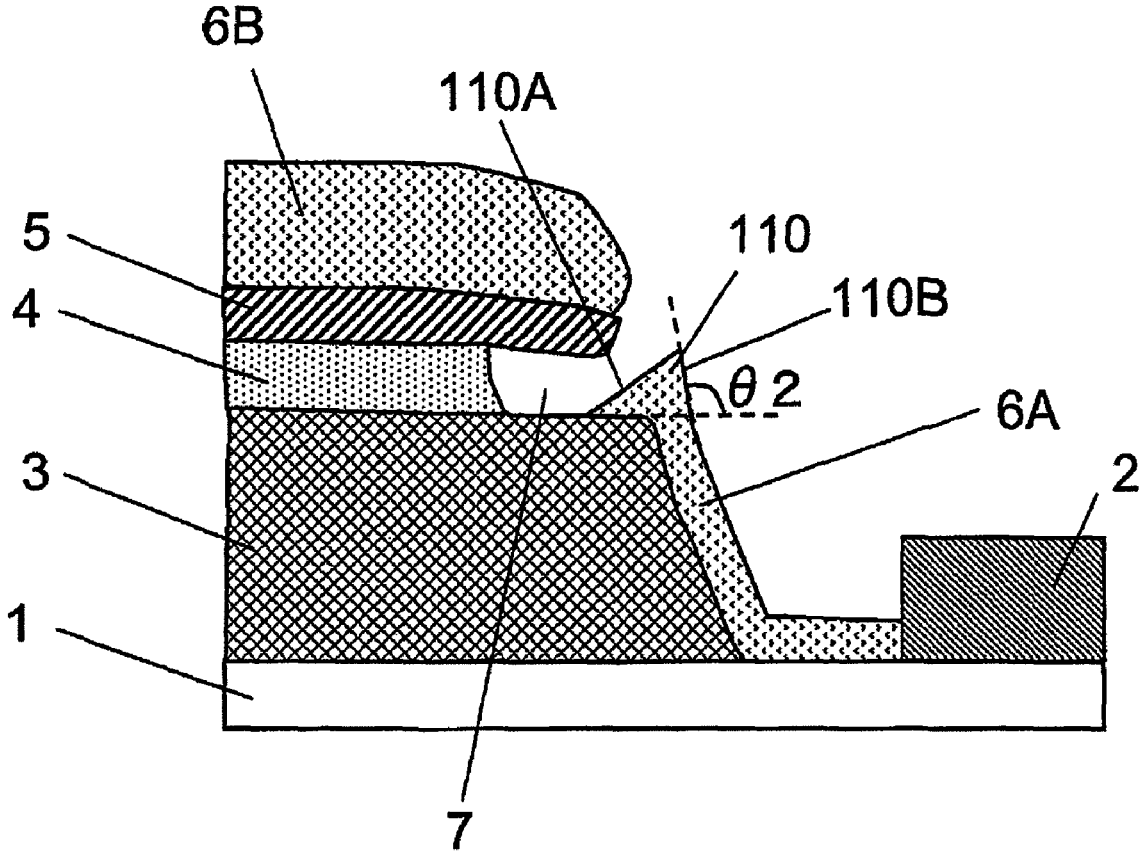
FIG. 8 is a diagram illustrating a constitution of the electron-emitting device according to a comparative example.

For comparison, an electron-emitting device where θ2 shown in FIG. 8 was about 90° (the angle slightly larger than 90°) was manufactured by changing only the shape of the protruding portion as the electron-emitting device in the electron-emitting device of example 1.

Figure 6:
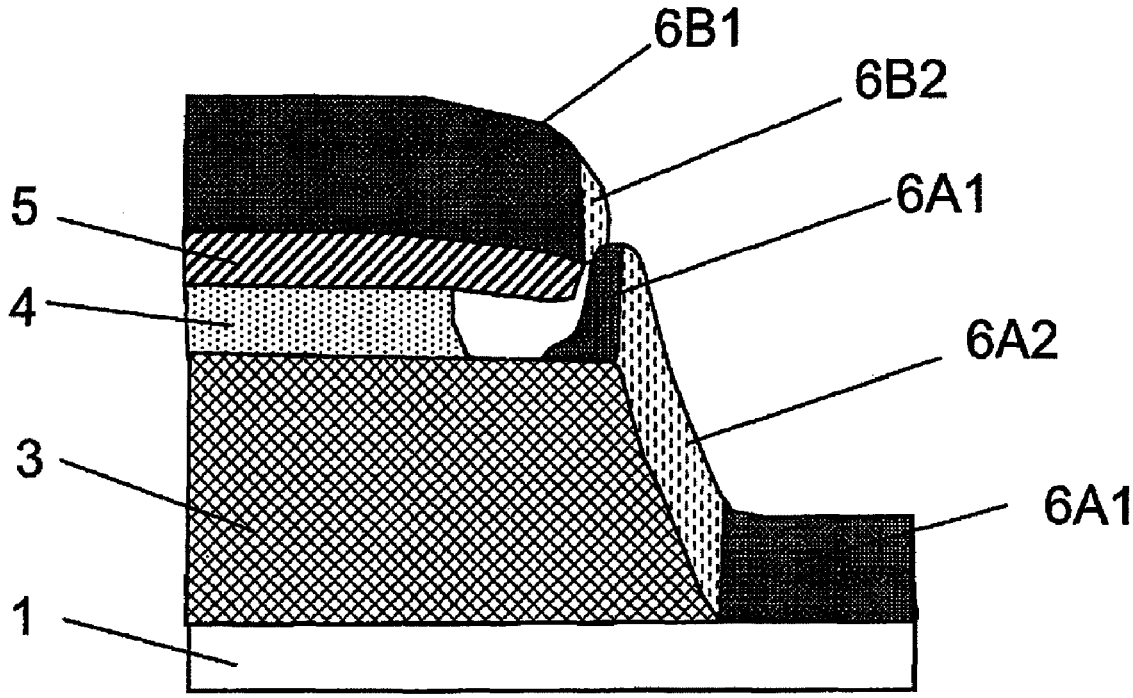
FIG. 6 is a diagram explaining film density of a conductive film.

In the method similar to that of example 1, the shielding plate used in example 1 was removed at the time of depositing the conductive films 6A and 6B, so that an incident angle of sputtered particles was distributed (as a result, a difference in the film density of Mo on respective portions shown in FIG. 6 became small, and generation of the difference in the etching rate on the respective portions was repressed at the time of etching for forming the protruding shape of the conductive film 6A). The dry etching after the step of oxidation using excimer UV and removing the oxide film by hot water, which was executed in example 1, was not performed in this comparative example. The other steps were the same as those in example 1, and the electron-emitting device was obtained.

As a result of the analysis using the cross-section TEM, the shortest distances 8 between protruding portions 110 to be the electron-emitting portions (FIG. 8) of the conductive film 6A (conductive films 6A1 to 6A4) and the gate electrode 5 were averagely 20 nm, which was equivalent to the electron-emitting device in example 1. However, the angle θ2 of the second slope 110B of the protruding portion 110 was about 90°.

A characteristic of the electron-emitting device having the constitution shown in FIG. 2 was evaluated. The electric potential of the gate electrode 5 (and the conductive films 6B1 to 6B4) was set to 30 V, and the electric potential of the conductive films 6A1 to 6A4 was set to 0 V via the cathode electrode 2. As a result, a drive voltage of 30 V was applied between the gate electrode 5 and the conductive films 6A1 to 6A4, but an electron emission current Ie was hardly measured. As a result of setting the voltage to 35 V, therefore, the obtained electron emission current was 6 μA, but the electron emission efficiency was averagely 3%.

It is considered that the electron field concentration of the tip of the protruding portion 110 of the conductive film 6A reduces because the angle θ2 in FIG. 8 is large in comparison with the electron-emitting device of example 1, and thus the electrons are emitted from places other than the tip. This is because as a result that the electrons are emitted from a place where the distance between the first slope 110A of the protruding portion 110 and the gate electrode 5 is the shortest, the electrons which do not reach the anode electrode and are absorbed to the gate electrode 5 increase.

Example 2

Since the basic method for manufacturing the electron-emitting device in this example is similar to that of example 1, only a difference from example 1 is described.

In this example, the process for dividing the conductive films 6A and 6B was not performed, and as shown in FIG. 1A, one conductive film 6A and one conductive film 6B were formed. The width of the conductive film was set to 100 μm. At the other steps which were completely the same as those in example 1, the electron-emitting device was created, and its characteristic was evaluated by the constitution shown in FIG. 2. In the evaluation of the characteristic, the electric potential of the gate electrode 5 (and the conductive film 6B) was set to 33 V, and the electric potential of the conductive film 6A was set to 0 V via the electrode 2. As a result, a drive voltage of 33 V was applied between the gate electrode 5 and the conductive film 6A. As a result, the electron-emitting device in which the average electron emission current Ie was 12 μA and the electron emission efficiency was averagely 17% was obtained.

Example 3

Since the basic method of manufacturing the electron-emitting device in this example is similar to that in the example 1, only a difference from the example 1 is described.

The first to the third etching processes were executed in the manufacturing method similar to that in the example 1. Although the oxidizing step and the removing step were repeated at three cycles in the example 1, these steps were repeated at six cycles in this example. As a result, the pointing of the protruding portion of the conductive film 6A (the conductive films 6A1 to 6A4) was accelerated further than the example 1. On the other hand, the gap between the conductive films 6A1 to 6A4 and the conductive films 6B1 to 6B4 was widened up to 25 nm, and Mo was mostly removed from the slope of the first insulating layer 3 (FIG. 5A)

As shown in FIG. 5B, the conductive coating films (9A and 9B) were formed on the conductive films 6A1 to 6A4, the conductive films 6B1 to 6B4 and the slope of the first insulating layer 3. As the coating film, n-type diamond films (9A and 9B) were formed by a CVD method. At this time, the n-type diamond films (9A and 9B) were deposited by using a metal mask having openings formed at corresponding device positions. The n-type diamond films (9A and 9B) were deposited so that their thickness was 10 nm. In the case of this example, electrons were emitted from the n-type diamond films (9A and 9B) on the protruding portions.

As a result of the analysis using the cross-section TEM, the shortest distances 8 between the n-type diamond film 9A to be the electron-emitting portion on the protruding portion and the gate electrode 5 in FIG. 5B was averagely 15 nm.

Next, Cu film was formed as the electrode 2 similarly to the example 1.

After the electron-emitting device was formed by the above method, the characteristics of the electron-emitting device were evaluated by the constitution shown in FIG. 2.

In the evaluation of the characteristics, the potential of the gate electrode 5 (and the conductive films 6B1 to 6B4 and n-type diamond film 9B) was set to 26 V, and the potential of the n-type diamond film 9A was defined as 0 V via the electrode 2. As a result, a drive voltage of 26 V was applied between the gate electrode 5 and the n-type diamond film 9A. As a result, in the electron-emitting device, the average electron-emitting current Ie was 7 μA, and the average electron emission efficiency was 18%. In the electron-emitting device of this example, the electron emission could be maintained for a long period more stably than the electron-emitting device of example 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-26488, filed on Feb. 6, 2009, which is hereby incorporated by reference here in its entirety.

What is claimed is:

1. An electron-emitting device comprising:

an insulating layer having a side surface;

a recess portion which is formed on the side surface of the insulating layer;

a gate electrode which is arranged above the recess portion; and a wedge-shaped emitter which is arranged on an edge of a lower side of the recess portion and has a first slope on a side of the recess portion and a second slope on a side opposite to the recess portion, wherein a lower end of the first slope of the emitter enters the recess portion, both the first slope and the second slope of the emitter tilt to an outside of the recess portion.

2. An electron-emitting device according to claim 1, wherein a tip of the emitter protrudes to an outside in a horizontal direction with respect to a side end of the gate electrode.

3. An electron-emitting device according to claim 1, wherein the emitter is covered with a film having a lower work function than that of a material of the emitter.

4. An electron-emitting device according to claim 1, having a plurality of the emitters.

5. An image display apparatus comprising:

a plurality of electron-emitting devices and a light-emitting member which emits light due to electrons emitted from the plurality of electron-emitting devices, wherein each of the electron-emitting devices is the electron emitting device according to claim 1.

* * * * *